US009809418B2

(12) United States Patent
Nagarajan et al.

(10) Patent No.: US 9,809,418 B2
(45) Date of Patent: Nov. 7, 2017

(54) ADVANCED SMOOTH RESCUE OPERATION

(71) Applicant: Otis Elevator Company, Farmington, CT (US)

(72) Inventors: Prasanna Nagarajan, Farmington, CT (US); Amir Lotfi, South Windsor, CT (US); Edward Piedra, Chicopee, MA (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/056,158

(22) Filed: Feb. 29, 2016

(65) Prior Publication Data

US 2017/0247222 A1 Aug. 31, 2017

(51) Int. Cl.

| | |
|---|---|
| ***B66B 5/06*** | (2006.01) |
| ***B66B 1/32*** | (2006.01) |
| ***B66B 13/14*** | (2006.01) |
| ***B66B 1/28*** | (2006.01) |

(52) U.S. Cl.
CPC ..... *B66B 1/28* (2013.01); *B66B 2201/34* (2013.01)

(58) Field of Classification Search
USPC ..... 187/247
See application file for complete search history.

(56) References Cited

U.S. PATENT DOCUMENTS

| | | | | |
|---|---|---|---|---|
| 4,478,315 | A | 10/1984 | Nomura | |
| 5,035,301 | A | 7/1991 | Skalski | |
| 5,070,290 | A | 12/1991 | Iwasa et al. | |
| 5,085,294 | A | 2/1992 | Iwata | |
| 5,893,432 | A | 4/1999 | Nguyen et al. | |
| 6,196,355 | B1 * | 3/2001 | Fargo | B66B 5/027 187/287 |
| 6,315,081 | B1 | 11/2001 | Yeo | |
| 6,435,312 | B2 | 8/2002 | Tajima et al. | |
| 6,802,395 | B1 | 10/2004 | Helstrom et al. | |

(Continued)

FOREIGN PATENT DOCUMENTS

| | | | |
|---|---|---|---|
| DE | 102009049267 | A1 | 4/2011 |
| JP | 2014172761 | A | 9/2014 |

OTHER PUBLICATIONS

European Search Report for application EP 17157794.3, dated Jun. 26, 2017, 16pgs.

*Primary Examiner* — Christopher Uhlir
(74) *Attorney, Agent, or Firm* — Cantor Colburn LLP

(57) ABSTRACT

According to one embodiment, a method of operating an elevator system is provided. The method includes detecting, using a controller, when an external power source is unavailable. The method also includes controlling, using the controller, a plurality of components of the elevator system. The controlling comprises operating at least one of an elevator car, a drive unit, an inverter and a brake. The method further includes detecting, using the controller, an original direction of travel of the elevator car. The method yet further includes detecting, using the controller, a mode of the elevator car, wherein the mode includes at least one of a motoring mode, a near balance mode, and a regenerative mode. The method includes determining, using the controller, a target floor. The method also includes adjusting, using the controller, a velocity of the elevator car to reach the target floor in response to the mode detected.

4 Claims, 5 Drawing Sheets

(56) References Cited

U.S. PATENT DOCUMENTS

| | | | | |
|---|---|---|---|---|
| 7,686,139 | B2 * | 3/2010 | Kondo | B66B 1/32 187/277 |
| 7,775,330 | B2 | 8/2010 | Kattainen et al. | |
| 7,921,969 | B2 * | 4/2011 | Stolt | B66B 1/30 187/293 |
| 7,931,127 | B2 * | 4/2011 | Kondo | B66B 1/32 187/277 |
| 7,967,113 | B2 | 6/2011 | Smith et al. | |
| 8,267,224 | B2 | 9/2012 | Gremaud et al. | |
| 8,789,659 | B2 | 7/2014 | Agirman et al. | |
| 8,869,945 | B2 | 10/2014 | Härkönen et al. | |
| 9,227,815 | B2 | 1/2016 | Martinelli et al. | |
| 2008/0073157 | A1 * | 3/2008 | Kanon | B66B 5/027 187/290 |
| 2011/0120810 | A1 * | 5/2011 | Schroeder-Brumloop | B66B 5/027 187/290 |
| 2015/0353321 | A1 | 12/2015 | Fargo | |

* cited by examiner

ADVANCED SMOOTH RESCUE OPERATION

BACKGROUND

The subject matter disclosed herein relates generally to the field of elevator systems, and specifically to a method and apparatus for bringing an elevator to a controlled stop when power from an external power source is unavailable.

A typical elevator system includes a car and a counterweight disposed within a hoistway, a plurality of tension ropes that interconnect the car and counterweight, and a drive unit having a drive sheave engaged with the tension ropes to drive the car and the counterweight. The ropes, and thereby the car and counterweight, are driven by rotating the drive sheave. Traditionally, the drive unit and its associated equipment were housed in a separate machine room.

Newer elevator systems have eliminated the need for a separate machine room by mounting the drive unit in the hoistway. These elevator systems are referred to as machine room-less systems. Traditionally, elevator systems have been dependent on an external power source for operation, which complicates operation in the event that the external power source is unavailable.

BRIEF SUMMARY

According to one embodiment, a method of operating an elevator system is provided. The method includes detecting, using a controller, when an external power source is unavailable. The method also includes controlling, using the controller, a plurality of components of the elevator system. The controlling comprises operating at least one of an elevator car, a drive unit, an inverter and a brake. The method further includes detecting, using the controller, an original direction of travel of the elevator car. The method yet further includes detecting, using the controller, a mode of the elevator car, wherein the mode includes at least one of a motoring mode, a near balance mode, and a regenerative mode. The method includes determining, using the controller, a target floor. The method also includes adjusting, using the controller, a velocity of the elevator car to reach the target floor in response to the mode detected.

In addition to one or more of the features described above, or as an alternative, further embodiments of the method may include allowing, using the controller, the velocity of the elevator car to decrease to about zero velocity, when the motoring mode is detected; and allowing, using the controller, the velocity of the elevator car to increase in a direction opposite the original direction of travel to a selected creep velocity.

In addition to one or more of the features described above, or as an alternative, further embodiments of the method may include maintaining, using the controller, the selected creep velocity for a selected duration of time; decreasing, using the controller, the velocity of the elevator car in the direction opposite the original direction of travel, when the selected duration of time ends; adjusting, using the controller, the velocity of the elevator car as the elevator car approaches the target floor; and applying, using the controller, the brake when the elevator car is at the target floor.

In addition to one or more of the features described above, or as an alternative, further embodiments of the method may include deactivating, using the controller, the inverter when the selected creep velocity is less than a selected velocity in the direction opposite the original direction of travel; increasing, using the controller, the velocity of elevator car in the direction opposite the original direction of travel to a selected alternate creep velocity; maintaining, using the controller, the selected alternate creep velocity for a selected duration of time; decreasing, using the controller, the velocity of the elevator car in the direction opposite the original direction of travel, when the selected duration of time ends; adjusting, using the controller, the velocity of the elevator car as the elevator car approaches the target floor; and applying, using the controller, the brake when the elevator car is at the target floor.

In addition to one or more of the features described above, or as an alternative, further embodiments of the method may include determining, using the controller, a deceleration rate for the elevator car to reach the target floor, when the near balance mode is detected; allowing, using the controller, the velocity of the elevator car to decrease in accordance with the deceleration rate determined; adjusting, using the controller, the velocity of the elevator car as the elevator car approaches the target floor; and applying, using the controller, the brake when the elevator car is at the target floor.

In addition to one or more of the features described above, or as an alternative, further embodiments of the method may include allowing, using the controller, the velocity of the elevator car to decrease to a selected creep velocity, when the regenerative mode is detected; maintaining, using the controller, the selected creep velocity for a selected duration of time; decreasing, using the controller, the velocity of the elevator car to about zero, when the selected duration of time ends; adjusting, using the controller, the velocity of the elevator car as the elevator car approaches the target floor; and applying, using the controller, the brake when the elevator car is at the target floor.

In addition to one or more of the features described above, or as an alternative, further embodiments of the method may include maintaining, using the controller, the current velocity of the elevator car for a first selected duration of time, when the regenerative mode is detected; allowing, using the controller, the velocity of the elevator car to decrease to a selected creep velocity, when the first selected duration of time ends; maintaining, using the controller, the selected creep velocity for a second selected duration of time; decreasing, using the controller, the velocity of the elevator car to about zero, when the second selected duration of time ends; adjusting, using the controller, the velocity of the elevator car as the elevator car approaches the target floor; and applying, using the controller, the brake when the elevator car is at the target floor.

In addition to one or more of the features described above, or as an alternative, further embodiments of the method may include determining, using the controller, a deceleration rate for the elevator car to reach the target floor, when the regenerative mode is detected; allowing, using the controller, the velocity of the elevator car to decrease in accordance with the deceleration rate determined; adjusting, using the controller, the velocity of the elevator car as the elevator car approaches the target floor; and applying, using the controller, the brake when the elevator car is at the target floor.

According to another embodiment, an apparatus for operating an elevator system is provided. The apparatus includes an elevator car; a drive unit; an inverter; a brake; and a controller to control a plurality of components of the elevator system. The controlling comprises operating at least one of the elevator car, the drive unit, the inverter, and the brake. The controller performs operations comprising: detecting when the external power source is unavailable, detecting an original direction of travel of the elevator car, detecting a mode of the elevator car, wherein the mode includes at least one of a motoring mode, a near balance mode, and a regenerative mode, determining a target floor, and adjusting a velocity of the elevator car to reach the target floor in response to the mode detected.

In addition to one or more of the features described above, or as an alternative, further embodiments of the apparatus may include allowing the velocity of the elevator car to decrease to about zero velocity, when the motoring mode is detected; and allowing the velocity of the elevator car to increase in a direction opposite the original direction of travel to a selected creep velocity.

In addition to one or more of the features described above, or as an alternative, further embodiments of the apparatus may include maintaining the selected creep velocity for a selected duration of time; decreasing the velocity of the elevator car in the direction opposite the original direction of travel, when the selected duration of time ends; adjusting the velocity of the elevator car as the elevator car approaches the target floor; and applying the brake when the elevator car is at the target floor.

In addition to one or more of the features described above, or as an alternative, further embodiments of the apparatus may include deactivating the inverter when the selected creep velocity is less than a selected velocity in the direction opposite the original direction of travel; increasing the velocity of elevator car in the direction opposite the original direction of travel to a selected alternate creep velocity; maintaining the selected alternate creep velocity for a selected duration of time; decreasing the velocity of the elevator car in the direction opposite the original direction of travel, when the selected duration of time ends; adjusting the velocity of the elevator car as the elevator car approaches the target floor; and applying the brake when the elevator car is at the target floor.

In addition to one or more of the features described above, or as an alternative, further embodiments of the apparatus may include determining a deceleration rate for the elevator car to reach the target floor, when the near balance mode is detected; allowing the velocity of the elevator car to decrease in accordance with the deceleration rate determined; adjusting the velocity of the elevator car as the elevator car approaches the target floor; and applying the brake when the elevator car is at the target floor.

In addition to one or more of the features described above, or as an alternative, further embodiments of the apparatus may include allowing the velocity of the elevator car to decrease to a selected creep velocity, when the regenerative mode is detected; maintaining the selected creep velocity for a selected duration of time; decreasing the velocity of the elevator car to about zero, when the selected duration of time ends; adjusting the velocity of the elevator car as the elevator car approaches the target floor; and applying the brake when the elevator car is at the target floor.

In addition to one or more of the features described above, or as an alternative, further embodiments of the apparatus may include maintaining the current velocity of the elevator car for a first selected duration of time, when the regenerative mode is detected; allowing the velocity of the elevator car to decrease to a selected creep velocity, when the first selected duration of time ends; maintaining the selected creep velocity for a second selected duration of time; decreasing the velocity of the elevator car to about zero, when the second selected duration of time ends; adjusting the velocity of the elevator car as the elevator car approaches the target floor; and applying the brake when the elevator car is at the target floor.

In addition to one or more of the features described above, or as an alternative, further embodiments of the apparatus may include determining a deceleration rate for the elevator car to reach the target floor, when the regenerative mode is detected; allowing the velocity of the elevator car to decrease in accordance with the deceleration rate determined; adjusting the velocity of the elevator car as the elevator car approaches the target floor; and applying the brake when the elevator car is at the target floor.

Technical effects of embodiments of the present disclosure include an elevator system having a controller to bring an elevator car to a controlled stop when power from an external power source is unavailable. Further technical effects include that the controller detects the operating mode of the elevator car and adjusts the car velocity accordingly.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The foregoing and other features, and advantages of the disclosure are apparent from the following detailed description taken in conjunction with the accompanying drawings in which like elements are numbered alike in the several FIGURES.

DETAILED DESCRIPTION

Figure 1:
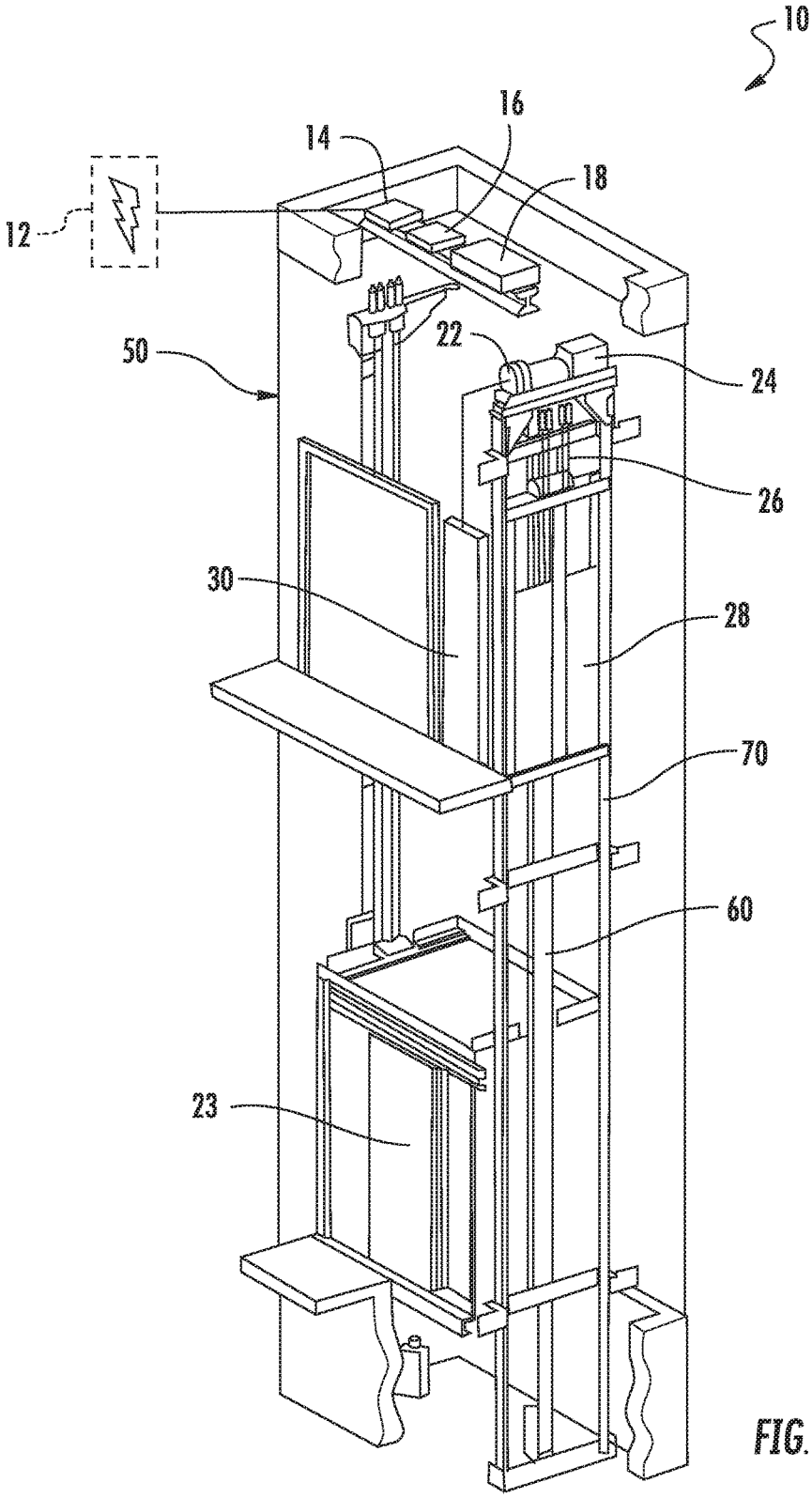
FIG. 1 illustrates a schematic view of an elevator system, in accordance with an embodiment of the disclosure.
Figure 2:
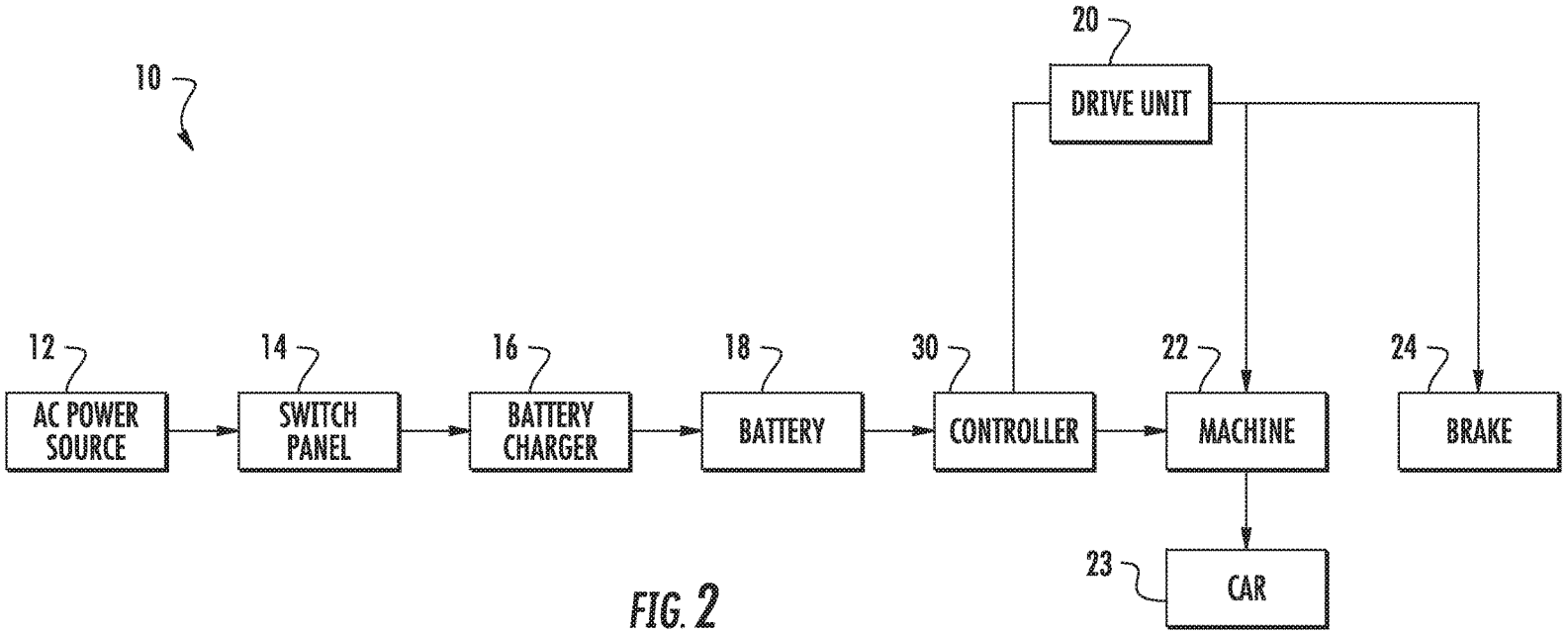
FIG. 2 is a block diagram of the elevator system of FIG. 1, in accordance with an embodiment of the disclosure.

Referring now to FIGS. 1 and 2. FIG. 1 shows a schematic view of an elevator system 10, in accordance with an embodiment of the disclosure. FIG. 2 shows a block diagram of the elevator system 10 of FIG. 1, in accordance with an embodiment of the disclosure. The elevator system 10 includes an elevator car 23 configured to move vertically upward and downward within a hoistway 50 along a plurality of car guide rails 60. The elevator system 10 also includes a counterweight 28 operably connected to the elevator car 23 via a pulley system 26. The counterweight 28 is configured to move vertically upward and downward within the hoistway 50. The counterweight 28 moves in a direction generally opposite the movement of the elevator car 23, as is known in conventional elevator systems. Movement of the counterweight 28 is guided by counterweight guide rails 70 mounted within the hoistway 50.

The elevator system 10 also includes an alternating current (AC) power source 12, such as an electrical main line (e.g., 230 volt, single phase). The AC power is provided from the AC power source 12 to a switch panel 14, which may include circuit breakers, meters, etc. From the switch panel 14, the AC power is provided to a battery charger 16, which converts the AC power to direct current (DC) power to charge a battery 18. The battery 18 may be a lead-acid, lithium ion or other type of battery. The battery 18 may power the elevator system 10 when an external power source (e.g. AC power source 12) is unavailable. The battery 18 may provide propulsive power and/or may serve as a backup power source to various components of the elevator system 10 including but not limited to the brakes 24, the elevator doors, and the position reference system. Alternatively, the battery 18 may also be another power source such as, for example a capacitor, gas powered generator, solar cells, hydroelectric generator, wind turbine generator or any other similar power generation and/or storage device. The DC power flows through the controller 30 to a drive unit 20, which contains an inverter to invert the DC power from the battery 18 to AC drive signals. The drive unit 20 drives a machine 22 to impart motion to the elevator car 23 via a traction sheave of the machine 22. The AC drive signals may be multiphase (e.g., three-phase) drive signals for a three-phase motor in the machine 22. The machine 22 also includes a brake 24 that can be activated to stop the machine 22 and elevator car 23.

The inverter within the drive unit 20 converts DC power from battery 18 to AC power for driving machine 22 in motoring mode. Motoring mode refers to situations where the machine 22 is drawing current from the drive unit 20. For example, motoring mode may occur when an empty elevator car is traveling downwards or a loaded elevator car is traveling upwards. The inverter of the drive unit 20 also converts AC power from machine 22 to DC power for charging battery 18 when operating in regenerative mode. Regenerative mode refers to situations where the drive unit 20 receives current from the machine 22 (which acts as a generator) and supplies current back to the AC power source 12. For example, regenerative mode may occur when an empty elevator car is traveling upwards or when a loaded elevator car is traveling downwards. There is also a near balance mode when the weight of the elevator car 23 is about balanced with the weight of the counterweight 28. Near balance mode operates similarly to motoring mode because the machine 22 is drawing current from the drive unit 20 to move the elevator car 23 out of the balance. As will be appreciated by those of skill in the art, motoring mode, regenerative mode, and near balance mode may occur in more than just the few examples described above and are within the scope of this disclosure.

The controller 30 is responsible for controlling the operation of the elevator system 10. The controller 30 may detect the original direction of travel of the elevator car 23. The controller 30 may also detect a mode of the elevator car 23. The mode may include at least one of a motoring mode, a near balance mode, and a regenerative mode, as previously described. The controller 30 may detect when the external power source 12 is unavailable. In the event the external power source 12 is unavailable, the controller 30 is responsible for determining a target floor and adjusting the velocity of the elevator car 23 to reach the target floor in response to the mode detected. The controller 30 may include a processor and an associated memory. The processor may be but is not limited to a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory may be but is not limited to a random access memory (RAM), read only memory (ROM), or other electronic, optical, magnetic or any other computer readable medium.

Figure 3:
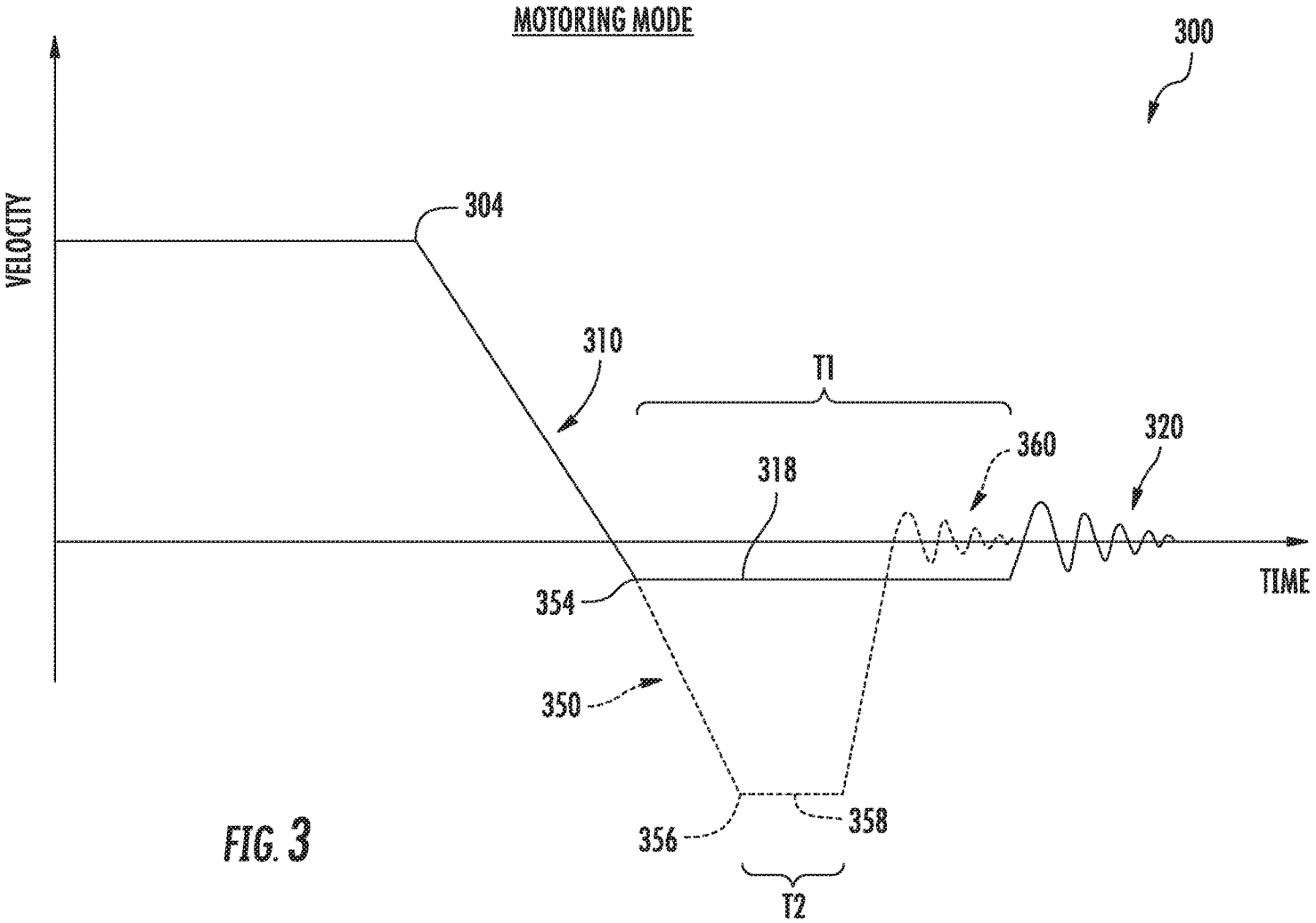
FIG. 3 is a velocity versus time graph illustrating the deceleration paths of an elevator car in motoring mode, in accordance with an embodiment of the disclosure.

Referring now also to FIG. 3, which shows a velocity versus time graph 300 illustrating the deceleration paths of an elevator car 23 in motoring mode, in accordance with an embodiment of the disclosure. FIG. 3 displays two deceleration options including a first path 310 and a second path 350 for the controller 30 to follow in the event external power is unavailable 304 while in motoring mode. The controller 30 will first detect the mode of the elevator car 23, which is motoring mode for FIG. 3. In the event external power is unavailable 304, on the first path 310 the controller 30 may allow the velocity of the elevator car 23 to decrease to about zero velocity. The controller 30 may utilize various methods including but not limited to back-emf braking and gravity to help decelerate. The controller 30 then allows the velocity of the elevator car 23 to increase in a direction opposite the original direction of travel to a selected creep velocity 318. For example, if an elevator car 23 was motoring up fully loaded with passengers, the controller 30 may let gravity bring the elevator car 23 to a halt (zero velocity) and then let it start to descend. The controller 30 maintains the selected creep velocity 318 for a selected duration of time T1. When the selected duration of time T1 ends, the controller 30 decreases the velocity of the elevator car 23 in the direction opposite the original direction of travel. Then at 320, the controller adjusts the velocity of the elevator car 23 as the elevator car 23 approaches the target floor and applies the brake 24 when the elevator car 23 is at the target floor.

The controller 30 may choose a second path 350 to follow, if at point 354 the selected creep velocity is less than a selected velocity in the direction opposite the original direction of travel. For the second path 350, the controller 30 deactivates the inverter at point 354 and increases the velocity of elevator car 23 in the direction opposite the original direction of travel to a selected alternate creep velocity 358. At 356, the controller 30 maintains the selected alternate creep velocity 358 for a selected duration of time T2 and then proceeds to decrease the velocity of the elevator car 23 in the direction opposite the original direction of travel. Then at 360, the controller adjusts the velocity of the elevator car 23 as the elevator car 23 approaches the target floor and applies the brake 24 when the elevator car 23 is at the target floor.

Figure 4:
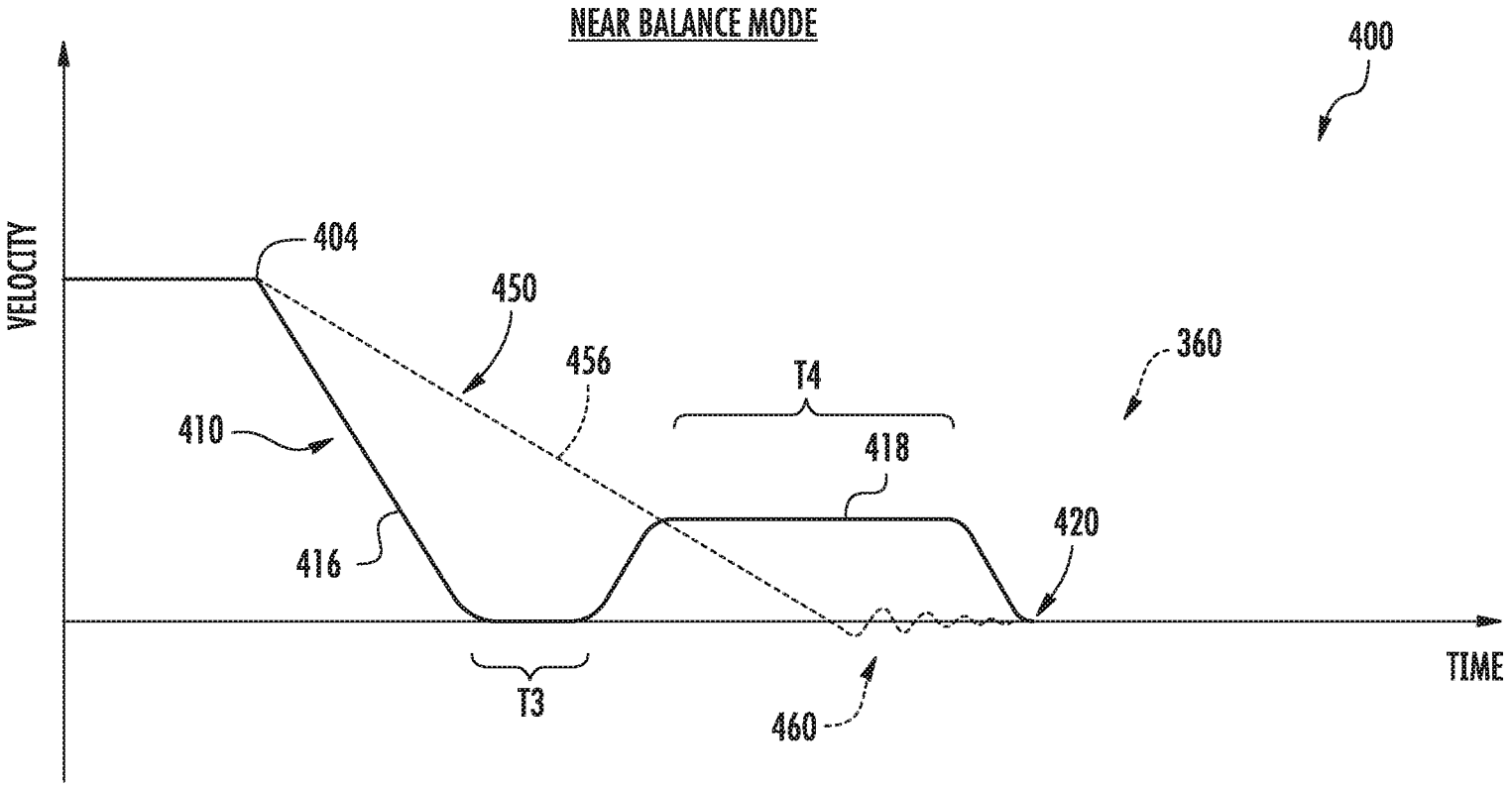
FIG. 4 is a velocity versus time graph illustrating the deceleration paths of an elevator car in near balance mode, in accordance with an embodiment of the disclosure.

Referring now also to FIG. 4, which shows a velocity versus time graph 400 illustrating the deceleration paths of an elevator car 23 in near balance mode, in accordance with an embodiment of the disclosure. FIG. 4 displays two deceleration options including a first path 410 and a second path 450 for the controller 30 to follow in the event of external power is unavailable 404 while in near balance mode. The controller will first detect the mode of the elevator car 23, which is near balance mode for FIG. 4. In the event external power is unavailable 404, on the first path 410 the controller 30 may allow the velocity of the elevator car 23 to decrease to about zero velocity at 416. The controller 30 may utilize various methods including but not limited to back-emf braking and gravity to help decelerate. The controller 30 maintains about zero velocity for a selected duration of time T3 and then the controller 30 increases the velocity of the elevator car 23 in the original direction of travel until it reaches an automatic rescue operation (ARO) velocity 418. The controller 30 maintains the ARO velocity for a second selected duration of time T4. Then at 420, the controller 30 decreases the velocity of the elevator car 23 as it approaches the target floor and applies the brake 24 when the elevator car 23 arrives at the target floor.

The controller 30 may choose a second path 450 to follow in near balance mode. On the second path 450, after external power is unavailable at 404 the controller 30 determines a deceleration rate for the elevator car 23 to reach the target floor. The controller 30 then allows the velocity of the elevator car 23 to decrease in accordance with the deceleration rate determined at 456. The controller 30 may utilize various methods include including but not limited to back-emf braking and gravity to help decelerate. Then at 460, the controller 30 adjusts the velocity of the elevator car 23 as the elevator car 23 approaches the target floor and applies the brake 24 when the elevator car 23 is at the target floor.

Figure 5:
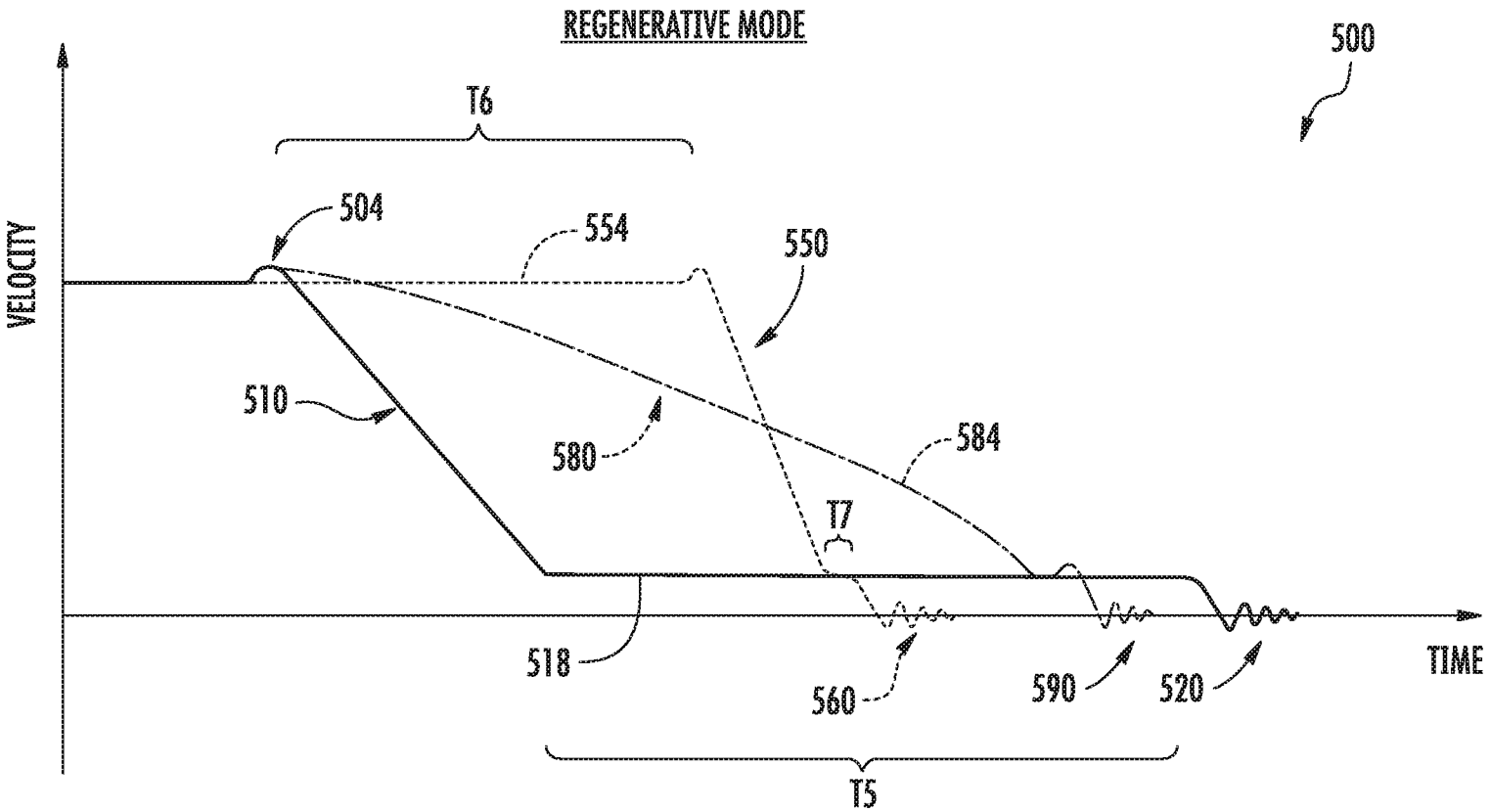
FIG. 5 is a velocity versus time graph illustrating the deceleration paths of an elevator car in regenerative mode, in accordance with an embodiment of the disclosure.

Referring now also to FIG. 5, which shows a velocity versus time graph 500 illustrating the deceleration paths of an elevator car 23 in regenerative mode, in accordance with an embodiment of the disclosure. FIG. 5 displays three deceleration options including a first path 510, a second path 550, and a third path 580 for the controller 30 to follow in the event of external power is unavailable at 404. The controller 30 will first detect the mode of the elevator car 23, which is regenerative mode for FIG. 5. In the event external power is unavailable 504, on the first path 510 the controller 30 allows the velocity of the elevator car 23 to decrease to a selected creep velocity 518, when the regenerative mode is detected. The controller 30 may utilize various methods including but not limited to back-emf braking and gravity to help decelerate. Then controller 30 maintains the selected creep velocity for a selected duration of time T5 and then decreases the velocity of the elevator car 23 to about zero when the selected duration of time T5 ends. Next at 520, the controller adjusts the velocity of the elevator car 23 as the elevator car 23 approaches the target floor and applies the brake 24 when the elevator car 23 is at the target floor.

The controller 30 may choose a second path 550 to follow in regenerative mode. On the second path 550, after external power is unavailable 504 the controller 30 maintains the current velocity of the elevator car 23 for a first selected duration of time T6 at 554, when the regenerative mode is detected. The controller 30 then allows the velocity of the elevator car 23 to decrease to a selected creep velocity, when the first selected duration of time T6 ends. The controller 30 may utilize various methods including but not limited to back-emf braking and gravity to help decelerate. Next, the controller 30 maintains the selected creep velocity for a second selected duration of time T7 and then decreases the velocity of the elevator car 23 to about zero, when the second selected duration of time T7 ends. Then at 560, the controller 30 adjusts the velocity of the elevator car 23 as the elevator car 23 approaches the target floor and applies the brake 24 when the elevator car 23 is at the target floor.

The controller 30 may choose a third path 580 to follow in regenerative mode. On the third path 580, after external power is unavailable 504, the controller 30 determines a deceleration rate for the elevator car 23 to reach the target floor. Next, the controller 30 allows the velocity of the elevator car 23 to decrease in accordance with the deceleration rate determined at 584. The controller 30 may utilize various methods including but not limited to back-emf braking and gravity to help decelerate. Then at 590, the controller 30 adjusts the velocity of the elevator car 23 as the elevator car 23 approaches the target floor and applies the brake 24 when the elevator car 23 is at the target floor.

The terminology used herein is for the purpose of describing particular embodiments only and is not intended to be limiting. While the description has been presented for purposes of illustration and description, it is not intended to be exhaustive or limited to embodiments in the form disclosed. Many modifications, variations, alterations, substitutions or equivalent arrangement not hereto described will be apparent to those of ordinary skill in the art without departing from the scope of the disclosure. Additionally, while the various embodiments have been described, it is to be understood that aspects may include only some of the described embodiments. Accordingly, the disclosure is not to be seen as limited by the foregoing description, but is only limited by the scope of the appended claims.

What is claimed is:

1. A method of operating an elevator system, the method comprising:

detecting, using a controller, when an external power source is unavailable;

controlling, using the controller, a plurality of components of the elevator system, wherein controlling comprises operating at least one of an elevator car, a drive unit, an inverter and a brake;

detecting, using the controller, an original direction of travel of the elevator car;

detecting, using the controller, a mode of the elevator car, wherein the mode includes at least one of a motoring mode, a near balance mode, and a regenerative mode;

determining, using the controller, a target floor; and adjusting, using the controller, a velocity of the elevator car to reach the target floor in response to the mode detected; allowing, using the controller, the velocity of the elevator car to decrease to about zero velocity, when the near balance mode is detected; maintaining, using the controller, the about zero velocity for a selected duration of time; increasing, using the controller, the velocity of the elevator car in the original direction of travel until it reaches an automatic rescue operation velocity; maintaining, using the controller, the automatic rescue operation velocity for a second selected duration of time; and decreasing, using the controller, the velocity of the elevator car as the elevator car approaches the target floor;

wherein secondary power is provided to the brake, elevator doors, and a positional reference system in the controller;

wherein secondary power is not provided to a drive unit to propel the elevator.

2. A method of operating an elevator system, the method comprising:

detecting, using a controller, when an external power source is unavailable;

controlling, using the controller, a plurality of components of the elevator system, wherein controlling comprises operating at least one of an elevator car, a drive unit, an inverter and a brake;

detecting, using the controller, an original direction of travel of the elevator car;

detecting, using the controller, a mode of the elevator car, wherein the mode includes at least one of a motoring mode, a near balance mode, and a regenerative mode;

determining, using the controller, a target floor;

adjusting, using the controller, a velocity of the elevator car to reach the target floor in response to the mode detected;

allowing, using the controller, the velocity of the elevator car to decrease to about zero velocity, when the motoring mode is detected;

allowing, using the controller, the velocity of the elevator car to increase in a direction opposite the original direction of travel to a selected creep velocity;

deactivating, using the controller, the inverter when the selected creep velocity is less than a selected velocity in the direction opposite the original direction of travel;

increasing, using the controller, the velocity of elevator car in the direction opposite the original direction of travel to a selected alternate creep velocity;

maintaining, using the controller, the selected alternate creep velocity for a selected duration of time;

decreasing, using the controller, the velocity of the elevator car in the direction opposite the original direction of travel, when the selected duration of time ends;

adjusting, using the controller, the velocity of the elevator car as the elevator car approaches the target floor; and applying, using the controller, the brake when the elevator car is at the target floor.

3. An apparatus for operating an elevator system, the apparatus comprising:

an elevator car;

a drive unit;

an inverter;

a brake;

a controller to control a plurality of components of the elevator system, wherein controlling comprises operating at least one of the elevator car, the drive unit, the inverter, and the brake, wherein the controller performs operations comprising:

detecting when an external power source is unavailable, detecting an original direction of travel of the elevator car, detecting a mode of the elevator car, wherein the mode includes at least one of a motoring mode, a near balance mode, and a regenerative mode, determining a target floor, and adjusting a velocity of the elevator car to reach the target floor in response to the mode detected; allowing, using the controller, the velocity of the elevator car to decrease to about zero velocity, when the near balance mode is detected; maintaining, using the controller, the about zero velocity for a selected duration of time; increasing, using the controller, the velocity of the elevator car in the original direction of travel until it reaches an automatic rescue operation velocity; maintaining, using the controller, the automatic rescue operation velocity for a second selected duration of time; and decreasing, using the controller, the velocity of the elevator car as the elevator car approaches the target floor wherein secondary power is provided to the brake, elevator doors, and a positional reference system in the controller;

wherein secondary power is not provided to a drive unit to propel the elevator.

4. An apparatus for operating an elevator system, the apparatus comprising:

an elevator car;

a drive unit;

an inverter;

a brake:

a controller to control a plurality of components of the elevator system, wherein controlling comprises operating at least one of the elevator car, the drive unit, the inverter, and the brake;

wherein the controller performs operations comprising:

detecting when an external power source is unavailable;

detecting an original direction of travel of the elevator car;

detecting a mode of the elevator car, wherein the mode includes at least one of a motoring mode, a near balance mode, and a regenerative mode;

determining a target floor;

adjusting a velocity of the elevator car to reach the target floor in response to the mode detected;

allowing the velocity of the elevator car to decrease to about zero velocity, when the motoring mode is detected;

allowing the velocity of the elevator car to increase in a direction opposite the original direction of travel to a selected creep velocity;

deactivating the inverter when the selected creep velocity is less than a selected velocity in the direction opposite the original direction of travel;

increasing the velocity of elevator car in the direction opposite the original direction of travel to a selected alternate creep velocity;

maintaining the selected alternate creep velocity for a selected duration of time;

decreasing the velocity of the elevator car in the direction opposite the original direction of travel, when the selected duration of time ends;

adjusting the velocity of the elevator car as the elevator car approaches the target floor; and applying the brake when the elevator car is at the target floor.

* * * * *